US008200145B2

(12) United States Patent
Kondo

(10) Patent No.: US 8,200,145 B2
(45) Date of Patent: Jun. 12, 2012

(54) IMAGE FORMING APPARATUS

(75) Inventor: Hakudai Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 922 days.

(21) Appl. No.: 12/245,211

(22) Filed: Oct. 3, 2008

(65) Prior Publication Data

US 2009/0092432 A1 Apr. 9, 2009

(30) Foreign Application Priority Data

Oct. 5, 2007 (JP) ..... 2007-262342

(51) Int. Cl.

| | |
|---|---|
| ***G03G 15/00*** | (2006.01) |
| ***B65H 31/26*** | (2006.01) |
| ***B65H 31/00*** | (2006.01) |
| ***B65H 29/00*** | (2006.01) |

(52) U.S. Cl. ..... 399/405; 399/406; 271/220

(58) Field of Classification Search ..... 399/405, 399/406

See application file for complete search history.

(56) References Cited

U.S. PATENT DOCUMENTS

| | | | | |
|---|---|---|---|---|
| 4,068,837 | A * | 1/1978 | Lamos | 271/296 |
| 5,260,759 | A * | 11/1993 | Kobayashi | 399/405 |
| 7,761,047 | B2 * | 7/2010 | Uehara et al. | 399/406 |
| 2006/0008283 | A1 * | 1/2006 | Oohara et al. | 399/45 |
| 2006/0110198 | A1 * | 5/2006 | Kim et al. | 399/405 |
| 2007/0069454 | A1 * | 3/2007 | Ino | 271/220 |
| 2008/0044214 | A1 * | 2/2008 | Nakajima | 399/406 |

FOREIGN PATENT DOCUMENTS

| | | | |
|---|---|---|---|
| JP | 61-178752 | | 11/1986 |
| JP | 61-206559 | | 12/1986 |
| JP | 62-173342 | | 11/1987 |
| JP | 07061687 | A * | 3/1995 |
| JP | 09-077339 | | 3/1997 |
| JP | 11228008 | A * | 8/1999 |
| JP | 2004115254 | A * | 4/2004 |
| JP | 2004315104 | A * | 11/2004 |
| JP | 2005263355 | A * | 9/2005 |
| JP | 2007-055752 | | 3/2007 |
| JP | 2007217156 | A * | 8/2007 |
| JP | 2007246256 | A * | 9/2007 |
| JP | 2008239334 | A * | 10/2008 |

OTHER PUBLICATIONS

Machine Translation of JP 2004115254 A, JPO, Oct. 25, 2011.*

* cited by examiner

*Primary Examiner* — Judy Nguyen
*Assistant Examiner* — Nguyen Q Ha
(74) *Attorney, Agent, or Firm* — Banner & Witcoff, Ltd.

(57) ABSTRACT

An image forming apparatus is provided. The image forming apparatus includes a housing; a sheet discharging tray; a discharge unit, provided within the housing, the discharge unit configured to discharge a sheet into the sheet discharging tray; a pressing member, provided at a position downstream of the discharge unit in a conveying direction of the sheet, the pressing member configured to apply a pressing force to a surface of the sheet at a pressing position; and a pressing force changing unit which is configured to change the pressing force of the pressing member against the surface of the sheet.

19 Claims, 7 Drawing Sheets

IMAGE FORMING APPARATUS

CROSS REFERENCE TO RELATED APPLICATION

The present application claims priority from Japanese Patent Application No. 2007-262342, which was filed on Oct. 5, 2007, the disclosure of which is herein incorporated by reference in its entirety.

TECHNICAL FIELD

Apparatuses consistent with the present invention relate to image forming apparatus and, more particularly, to an image forming apparatus which provides more efficient discharging of a recording medium.

BACKGROUND

Japanese unexamined patent application publication No. JP-A-9-77339 describes a related art image forming apparatus. In fixing an image formed on the sheet in the related art image forming apparatus, because heat and pressure are applied on the sheet, there is a phenomenon called a curl in which the image fixed sheet is deformed or curved. As a means for preventing the sheet in a curled state from being discharged onto a sheet discharging tray, the related art image forming apparatus includes a pressing member that presses the sheet at a position which is upstream of the sheet discharging tray in a discharging direction.

The pressing member is provided in a discharge path of the sheet which is directed towards the sheet discharging tray, and elastically oscillates by receiving a pressing force from the sheet. And an elastic restoring force of the pressing member is applied as the pressing force for correcting the curl to the sheet while the sheet passes by the pressing member.

SUMMARY

Related art image forming apparatuses have a few disadvantages. For example, while the curl which occurs on the sheet typically varies with the water content in the sheet and/or the thickness of sheet, the elastic pressing force of the pressing member on the sheet in the related art image forming apparatus is constant. Therefore, in printing on, for example, a relatively poor, fragile, thin sheet, the pressing member is not oscillated by being pressed by the sheet if the elastic pressing force of the pressing member is too strong for the condition of the sheet. In this case, the sheet pushes against the pressing member, buckles and deforms, so that a paper jam occurs before the pressing member.

Conversely, in printing on the relatively thick, good, strong sheet, the curl can not be sufficiently corrected if the elastic pressing force of the pressing member is too weak for the condition of the sheet. In this case, the succeeding sheet collides against another previously discharged sheet which still has a curl and which is stacked on the sheet discharging tray, causing a risk that the previously stacked sheet is pushed forward by the sheet to be discharged.

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the invention to provide an image forming apparatus that can correct a curl in a sheet depending on the sheet.

According to an exemplary embodiment of the present invention, there is provided an image forming apparatus comprising a housing; a sheet discharging tray; a discharge unit, provided within the housing, the discharge unit configured to discharge a sheet into the sheet discharging tray; a pressing member, provided at a position downstream of the discharge unit in a conveying direction of the sheet, the pressing member configured to apply a pressing force to a surface of the sheet at a pressing position; and a pressing force changing unit which is configured to change the pressing force of the pressing member against the surface of the sheet.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

An image forming apparatus 1 according to an exemplary embodiment of the present invention will be described below with reference to the drawings. The image forming apparatus 1 may be, for example, an electro-photographic printer.

<Exemplary Embodiment 1>

Figure 1:
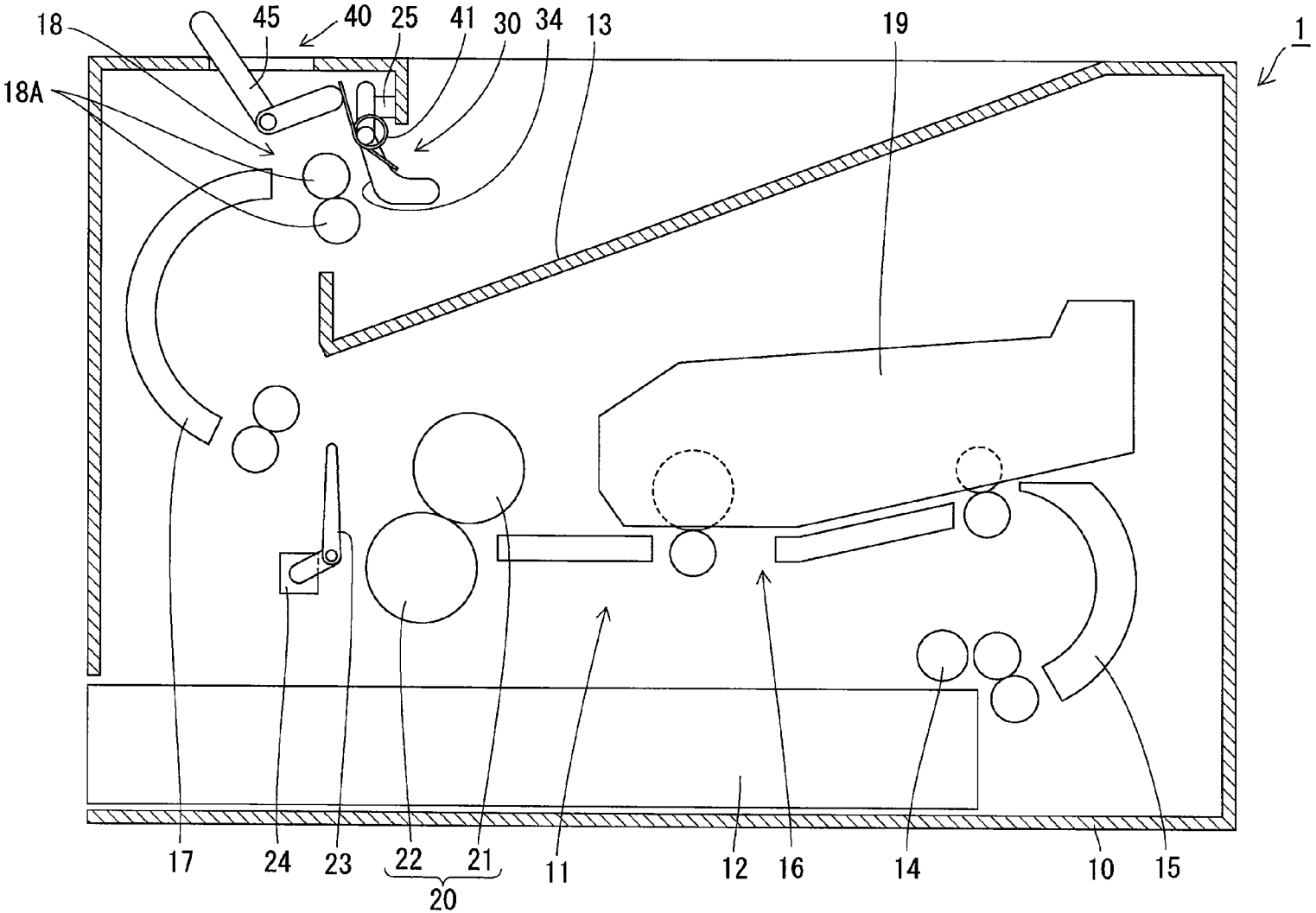
FIG. 1 is a cross-sectional view showing a schematic structure of an image forming apparatus according to an exemplary embodiment of the present invention.

FIG. 1 is a cross-sectional view of the image forming apparatus 1 according to an exemplary embodiment of the present invention. In FIG. 1, the longitudinal direction is defined as the front side to the right in the figure.

<Overall Constitution>

The image forming apparatus 1 comprises a sheet feed tray 12, a sheet discharging tray 13, a conveying unit 11, an image forming unit 19, a fixing unit 20, and a discharge unit 18, as shown in FIG. 1. The image forming unit 19 may be an image forming unit that operates according to an electro-photographic method. A sheet stored in the sheet feed tray 12 is conveyed to the image forming unit 19 by the conveying unit 11 to form a toner image, the toner image is fixed on the sheet by the fixing unit 20, and the sheet is discharged onto the sheet discharging tray 13 provided on the top of the housing 10 by the discharge unit 18.

The sheet feed tray 12 stores a stack of sheets, and is disposed on the bottom of the housing 10 and is removable from the housing 10.

The conveying unit 11 comprises a roller 14, a first turnover portion 15, a horizontal conveying unit 16, and a second turnover portion 17. The roller 14 contacts the sheet stacked on the sheet feed tray 12, and conveys the sheet in the sheet feed tray 12 to the first turnover portion 15 which makes the sheet U-turn, and then to the image forming unit 19 provided above the sheet feed tray 12. The horizontal conveying unit 16 is provided under the image forming unit 19, and the sheet passes through the horizontal conveying unit 16 and makes a U-turn at a second turnover portion 17 and is fed out to the discharge unit 18.

The image forming unit 19 is a known electro-photographic image forming unit comprising an exposing unit and a developing unit and forms a toner image (e.g., a picture) on the upper surface of the sheet conveyed along the horizontal conveying unit 16.

The fixing unit 20 is provided downstream of the image forming unit 19 in the conveying direction of the sheet, and comprises a heating roller 21 and a pressing roller 22. The heating roller 21 applies heat for fixing the image on the upper surface of the sheet, namely, on the surface where the toner image is formed. The pressing roller 22 presses the sheet against the heating roller 21, and makes the sheet contact with the heating roller 21. Accordingly, the toner image is fixed on the sheet by the heat and the pressure.

The sheet discharging tray 13 has a form in which the upper surface of the housing 10 is depressed, and is disposed downstream of the discharge unit 18 in the conveying direction. The sheet discharging tray 13 is provided above the fixing unit 20, with a down slope toward the back end (i.e., the left side in FIG. 1).

An actuator 23 and an optical sheet discharging sensor 24 are provided between the fixing unit 20 and the second turnover portion 17. The actuator 23 is oscillated and displaced when contacted by a leading edge of a sheet passing through the fixing unit 20 in the conveying direction, so that the oscillation of the actuator 23 is detected by the sheet discharging sensor 24. Also, after a trailing end of the sheet in the conveying direction passes through the actuator 23, the actuator 23 returns to the original position, and the sheet discharging sensor 24 detects the return of the actuator 23 to its original position.

The discharge unit 18, the pressing member 30, and the pressing force changing unit 40 will now be described. The pressing member 30 is an example of a sheet curl correcting unit.

<Discharge Unit 18>

The discharge unit 18 discharges the image fixed sheet onto the sheet discharging tray 13, and comprises upper and lower sheet discharging rollers 18A provided above the fixing unit 20, as shown in FIG. 1. The discharge unit 18 is disposed at the back end position of the sheet discharging tray 13 and slightly above a bottom of the sheet discharging tray 13. Accordingly, a sheet discharged forward from the discharge unit 18 is suspended over the sheet discharging tray 13, and falls onto the tray under its own weight. The fallen sheet slides toward the back end owing to the slope of the sheet discharging tray 13, so that a plurality of sheets are stacked one on another with the trailing edge aligned in the sheet discharging tray 13.

<Pressing Member 30>

Since the sheet heated in the fixing unit 20 is curled so that the margins (especially both the right and left edges at the trailing end in the conveying direction) roll up and since the sheet passes through the discharge unit 18 in a curled state, a pressing member 30 is provided.

Figure 2:
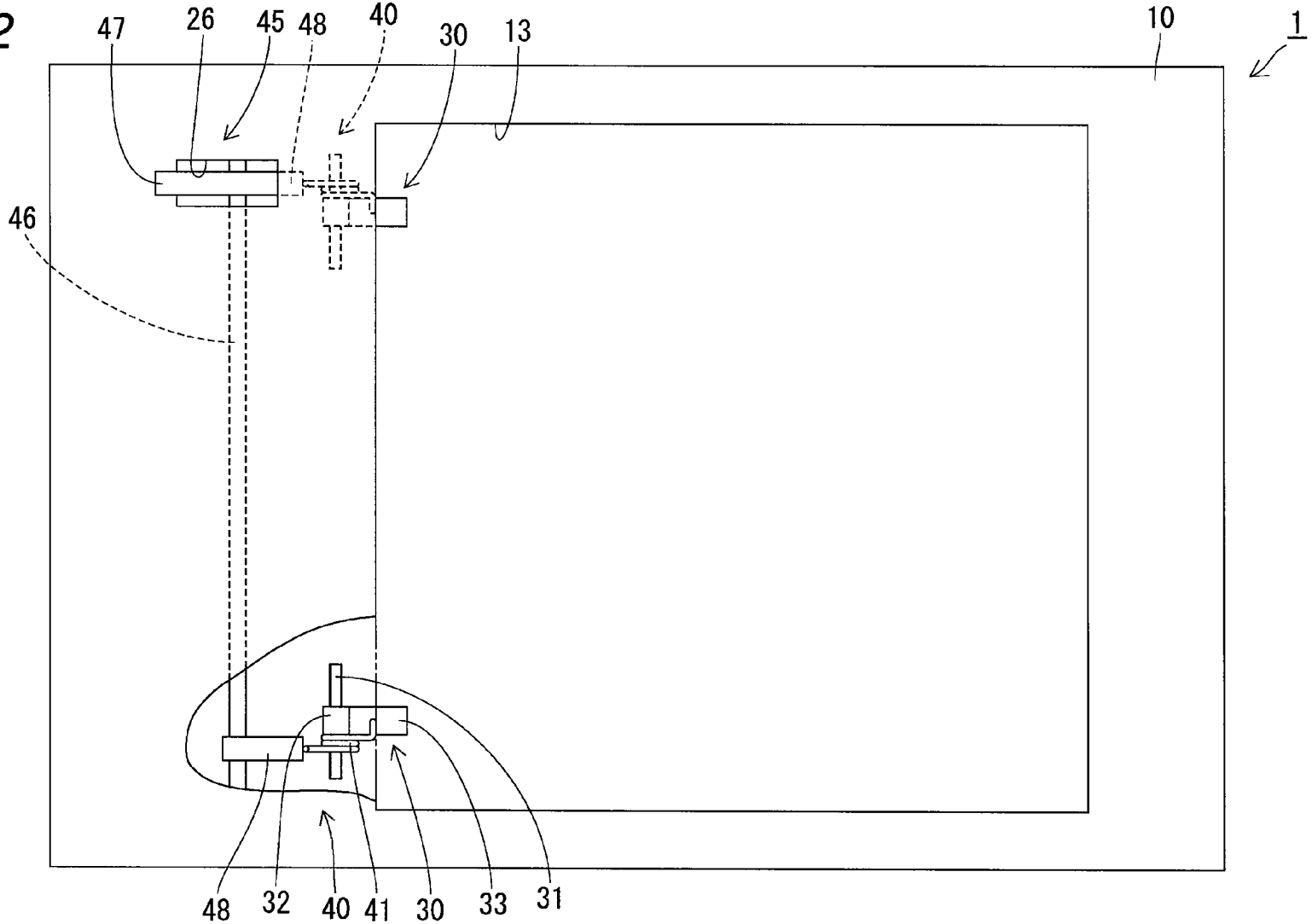
FIG. 2 is a plan view, partially cut away, of the image forming apparatus of FIG. 1.

FIG. 2 is a plan view of the image forming apparatus 1. One pair of right and left pressing members 30 are disposed at a downstream (forward) position of the discharge unit 18 in the discharging direction in the housing 10, as shown in FIG. 2. The positions of the pressing members 30 in the lateral direction (i.e., the width direction of the sheet) correspond respectively to the right and left sides of the sheet. Both the right and left sides of the sheet are the positions in which a curl is particularly likely to occur.

Figure 3:
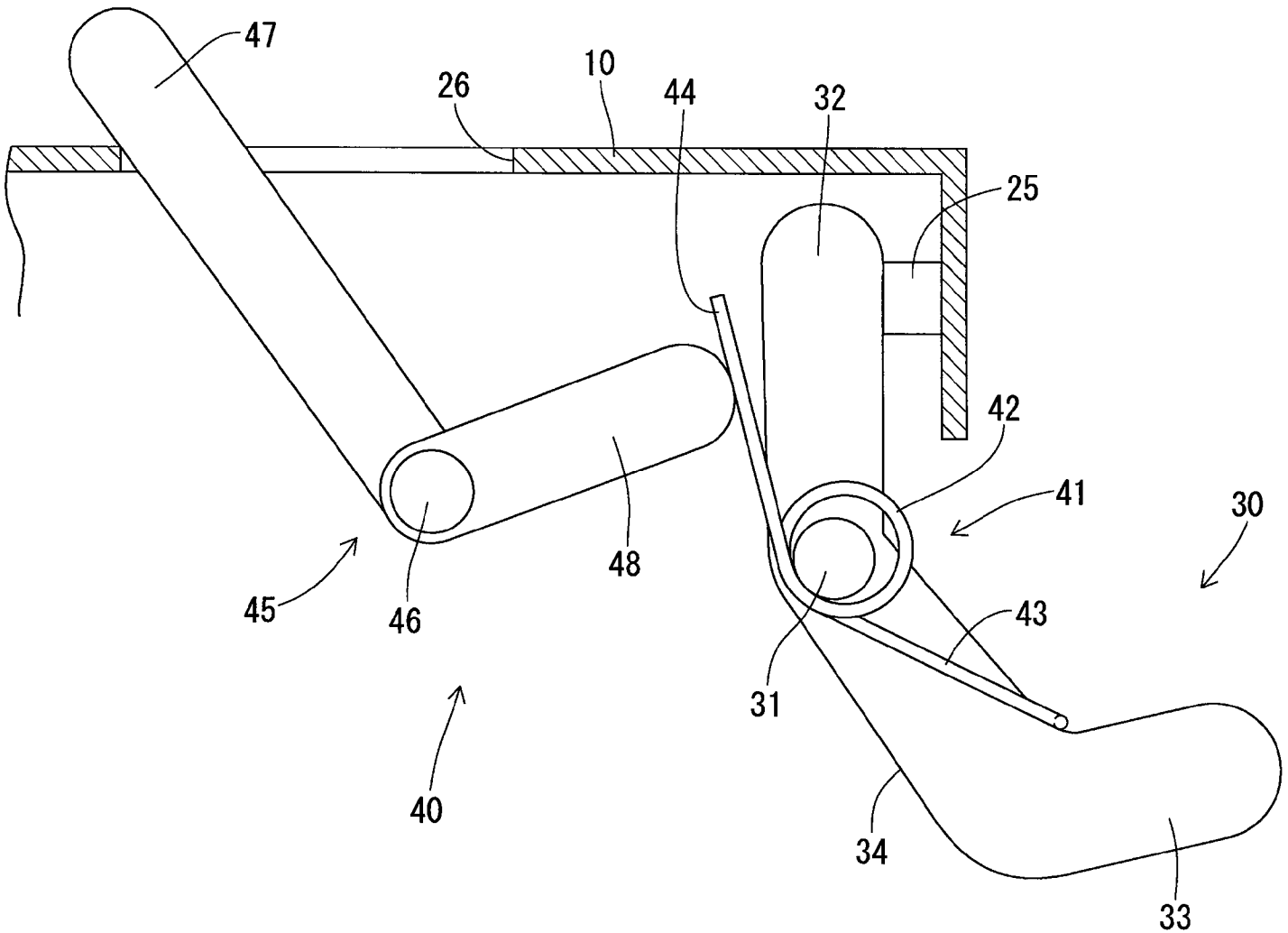
FIG. 3 is a partially enlarged side view of the image forming apparatus of FIG. 1 showing a pressing force changing unit according to a first exemplary embodiment of the present invention.
Figure 4:
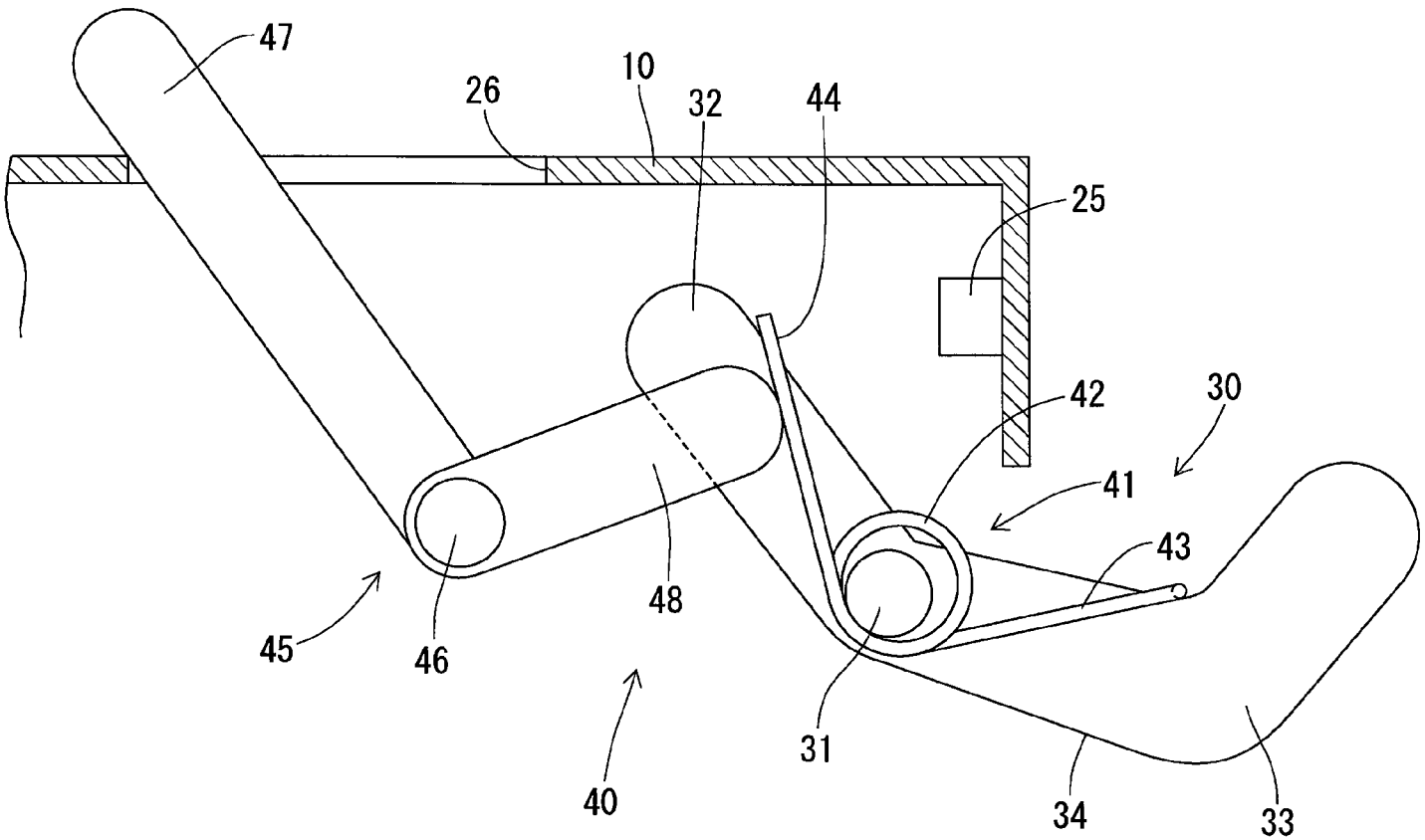
FIG. 4 is a partially enlarged side view of the pressing force changing unit of FIG. 3 showing a state in which a pressing member is pressed onto the sheet and oscillated.
Figure 5:
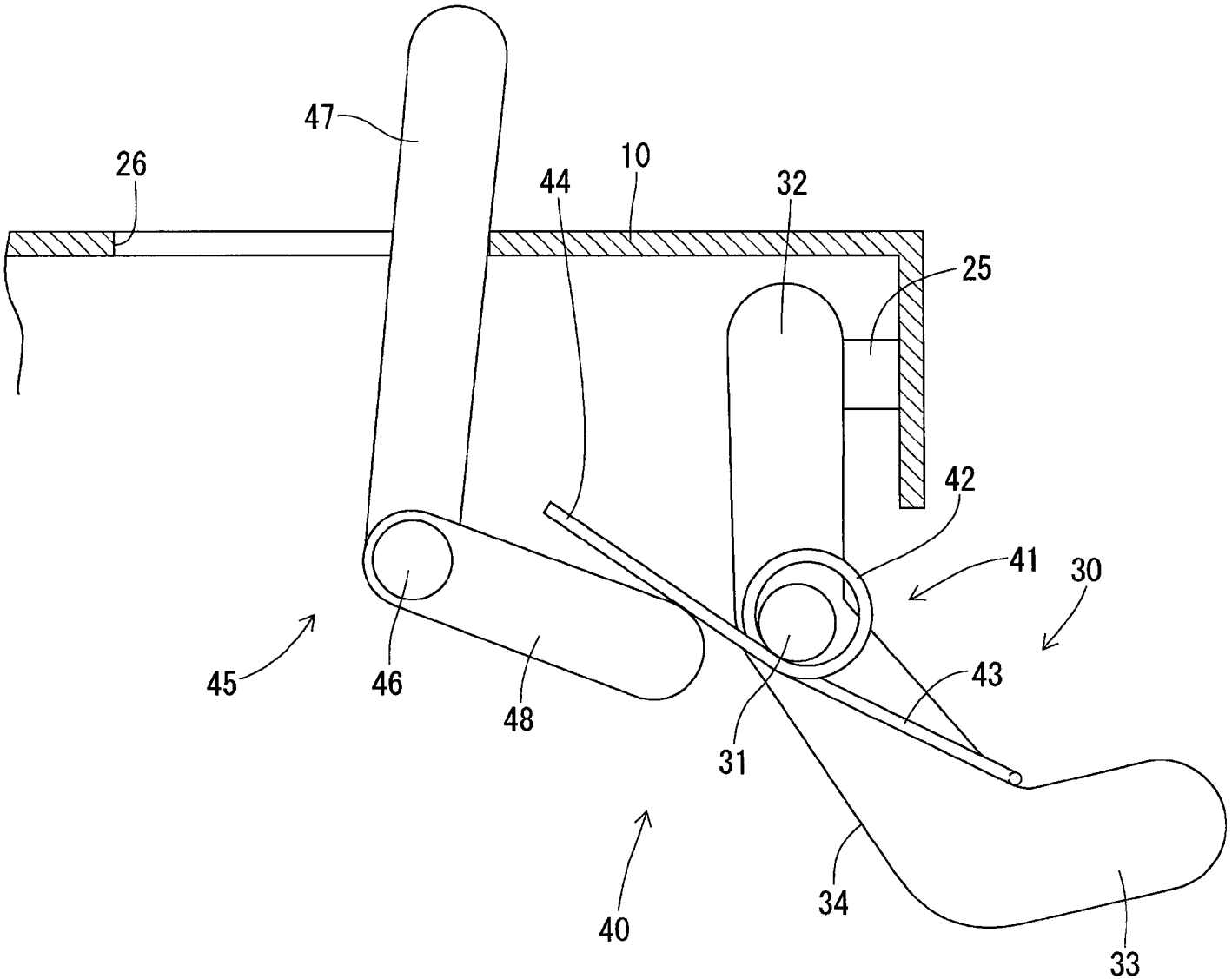
FIG. 5 is a partially enlarged side view of the pressing force changing unit of FIG. 3 showing a state in which a pressing force of the pressing member on the sheet is weakened.

FIG. 3 is a partially enlarged side view showing the pressing member 30 and the pressing force changing unit 40. FIG. 4 is a partially enlarged side view showing a state where the pressing member 30 is pressed onto the sheet and oscillated. FIG. 5 is a partially enlarged side view showing a state where a pressing force of the pressing member 30 on the sheet is weakened.

One pair of pressing members 30 are fixed to oscillate integrally with an oscillating shaft 31 in the lateral direction, as shown in FIGS. 3 to 5. The pressing member 30 comprises an oscillation regulation piece 32 protruding up from the oscillating shaft 31, and a pressing piece 33 protruding to the opposite side of the oscillation regulation piece 32, namely, obliquely to the lower front side of the oscillation regulation piece 32, around the oscillating shaft 31. The pressing member 30 is held at a pressing position owing to an urging force of a torsion coil spring 41 as will be described later.

The oscillation regulation piece 32 contacts a stopper 25 of the housing 10 from the back side to regulate the oscillation in the urging direction (clockwise direction in FIGS. 3 and 5) in a state in which the pressing member 30 is at the pressing position, as shown in FIGS. 3 and 5. In a state in which the pressing member 30 is held at the pressing position, the pressing piece 33 is disposed to intercept the front of the sheet discharged from one pair of sheet discharging rollers 18A.

A pressing surface 34 of the pressing piece 33 is inclined forward to slope downward in the discharging direction (i.e., an almost horizontal direction) of the sheet. Accordingly, the pressing position denotes a position at which the pressing member 30 can press the upper surface of the sheet opposite the sheet discharging tray 13 downward (i.e., towards the sheet discharging tray 13).

Also, the pressing member 30 held at the pressing position is displaceable in a pressing release direction releasing the pressure on the sheet against an urging force of the torsion coil spring 41. The pressing release direction is the counterclockwise direction in FIGS. 1 and 3 to 5, whereby the pressing piece 33 is displaced to retract upward out of a discharge path of the sheet as the pressing member 30 is oscillated in the pressing release direction.

<Pressing Force Changing Unit 40>

The pressing force changing unit 40 changes the pressing force of the pressing member 30 onto the sheet, and comprises the torsion coil spring 41 and a lever 45.

The torsion coil spring 41 comprises first and second arms 43 and 44 which extend from both ends of a coil portion 42. The coil portion 42 is mounted almost coaxially with the oscillating shaft 31, namely, to surround the oscillating shaft 31, as shown in FIGS. 3 to 5. The first arm 43 extends obliquely forward from the coil portion 42, and is engaged with an upper surface of the pressing member 30. The second arm 44 extends obliquely upward from the coil portion 42, and is located behind the oscillation regulation piece 32.

The lever 45 comprises an operation shaft 46 extending in the lateral direction, an operation portion 47 configured to be able to oscillate integrally with the operation shaft 46, and right and left engagement portions 48, corresponding to the right and left sides of the sheet. The operation portion 47 is fixed to at one end part of the operation shaft 46, and extends obliquely upward from the operation shaft 46. The operation portion 47 protrudes upward through an operation hole 26 opened on the upper surface of the housing 10, and the operation portion 47, thus exposed, can be manually operated.

The right and left engagement portions 48 are disposed to correspond respectively to the pressing members 30 positioned on either side of the image forming apparatus 1 in the lateral direction, and extend obliquely forward (in the direction approaching the pressing member 30) from the operation shaft 46. An extended end (i.e., front end) of the engagement portion 48 makes contact from behind with the second arm 44 extending backward of the oscillation regulation piece 32. With the contact action of the engagement portion 48, the coil portion 42 is elastically deformed, and owing to an elastic restoring force of the coil portion 42, an urging force is applied in a direction toward the pressing position via the first arm 43 on the pressing member 30.

The lever 45 can be manually operated between a first position (see FIGS. 3 and 4) which increases the pressing force of the pressing member 30 against the sheet, and a second position (see FIG. 5) which decreases the pressing force of the pressing member 30 against the sheet. In a state in which the lever 45 is at the first position, the elastic deformation amount of the coil portion 42 is increased, the elastic restoring force of the coil portion 42 is increased, and the downward elasticity (i.e., in the direction opposite to the direction of releasing the pressing force) applied from the second arm 44 to the pressing member 30 is increased.

Also, in a state in which the lever 45 is at the first position, the extended end of the engagement portion 48 engages the second arm 44 at the position above the operation shaft 46, so that the lever 45 is urged in the counterclockwise direction owing to an elastic reaction force of the coil portion 42, as shown in FIGS. 3 and 5. Accordingly, the operation portion 47 is pressed against the back end of the operation hole 26 owing to the urging force, whereby the lever 45 is held at the first position.

On the other hand, in a state in which the lever 45 is at the second position, the elastic deformation amount of the coil portion 42 is decreased, the elastic restoring force of the coil portion 42 is decreased, and the downward elasticity (in the direction opposite to the direction of releasing the pressing force) applied from the second arm 44 to the pressing member 30 is decreased. The elasticity applied to the pressing member 30 is equivalent to a force which will be necessary for the sheet to pass while pushing up the pressing piece 33.

Also, in a state in which the lever 45 is at the second position, the extended end of the engagement portion 48 engages the second arm 44 at a position below the operation shaft 46, so that the lever 45 is urged in the clockwise direction owing to an elastic reaction force of the coil portion 42, as shown in FIG. 5. Thus, the operation portion 47 is pressed against the front end of the operation hole 26 owing to the urging force, whereby the lever 45 is held at the second position.

<Operation and Effects of the First Exemplary Embodiment>

The lever 45 is switched between the first position and the second position depending on, for example, the degree of the curl and/or the thickness of the sheet. Thereby, the pressing force of the pressing member 30 on the sheet may be regulated.

If the pressing force of the pressing member 30, or the urging force applied from the torsion coil spring 41 to the pressing member 30 is too strong for the thickness of the sheet, the lever 45 is moved to reduce the pressing force of the pressing member 30. Alternatively, if the pressing force of the pressing member 30, or the urging force applied from the torsion coil spring 41 to the pressing member 30 is too weak for the thickness of the sheet, the lever 45 is moved to increase the pressing force of the pressing member 30.

Accordingly, the pressing force of the pressing member 30 is adequate for the thickness of the sheet, whereby the sheet pushes up and moves the pressing member 30 in the direction of releasing the pressing force without buckling, and passes under the pressing piece 33. At this time, as the oscillation angle of the pressing member 30 is greater, the elastic deformation amount of the coil portion 42 is increased, so that the pressing force applied from the pressing member 30 to the sheet is also increased. Thus the curl is corrected by the elastic pressing force of this pressing member 30.

At this time, when the pressing force from the pressing member 30 is too small for the magnitude of curl, the curl can not be securely corrected. If the sheet is discharged onto the sheet discharging tray 13 while the curl remains, the sheet is stacked with a gap left up or down, causing the stack height to be higher than the discharge unit 18. In this case, the sheet discharged later pushes against the trailing end of the stacked sheets, and some stacked sheets are pushed forward.

Moreover, since the pressing force of the pressing member 30 is adequate for the magnitude of curl, the curl is securely corrected, whereby the sheet is discharged onto the sheet discharging tray 13 in an almost flat condition. The sheet corrected for curl is stacked without gap, so that the stack height of sheet is suppressed to be low. Accordingly, the succeeding sheet does not push the stacked sheets forward.

Since the pressing force of the pressing member 30 on the sheet is appropriately changed depending on the strength of curl of the sheet and/or the thickness of the sheet, the curl of the sheet can be corrected without causing a paper jam or a phenomenon of pushing out the sheet.

Also, an urging member for applying the urging force to the pressing member 30 comprises a pair of arms 43 and 44 extend from both ends of the coil portion 42, and the coil portion 42 is disposed almost coaxially with the oscillating shaft 31 of the pressing member 30, in which the first arm 43 is engaged with the pressing member 30 and the second arm 44 is engaged with the lever 45. In this configuration, since the coil portion 42 for generating the urging force is disposed almost axially with the oscillating shaft 31 of the pressing member 30, space is saved.

Also, the urging force changing unit for changing the urging force of the torsion coil spring 41 is provided to be able to oscillate in the housing 10, and the lever 45 is in a form in which the operation portion 47 and the engagement portion 48 extend from the center of oscillation, and the engagement portion 48 is engaged with the second arm 44 of the torsion coil spring 41. In this configuration, the engagement portion 48 elastically deforms the torsion coil spring 41 while being oscillated by operating the operation portion 47, so that the urging force of the torsion coil spring 41 can be changed.

Since one pair of pressing members 30 are provided to be located at both ends, right and left, respectively, to press both ends of the sheet in the width direction, the curl occurring at both ends of the sheet in the width direction can be corrected effectively.

<Exemplary Embodiment 2>

Figure 6:
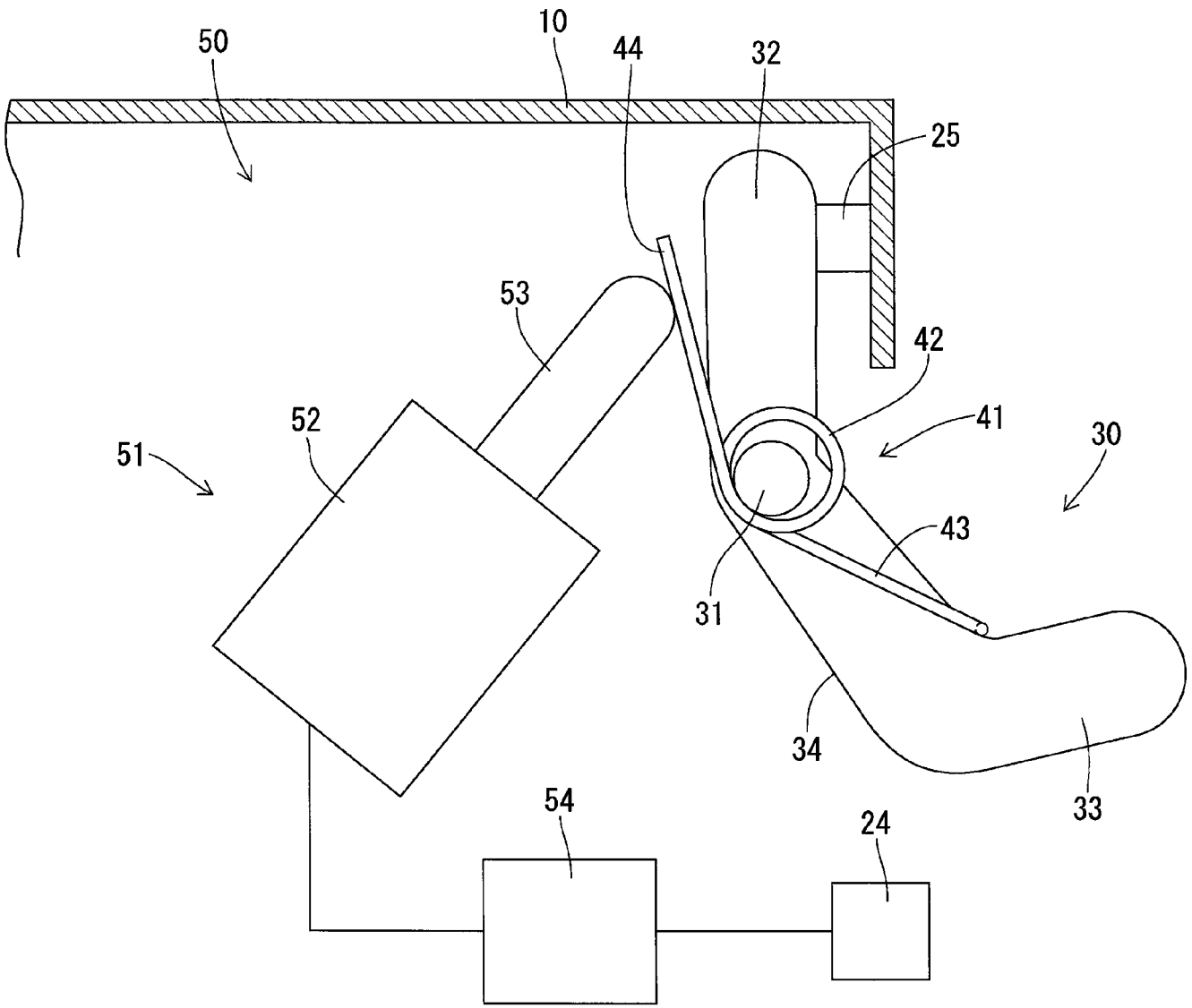
FIG. 6 is a partially enlarged side view of the image forming apparatus of FIG. 1 showing a pressing force changing unit according to a second exemplary embodiment of the present invention.
Figure 7:
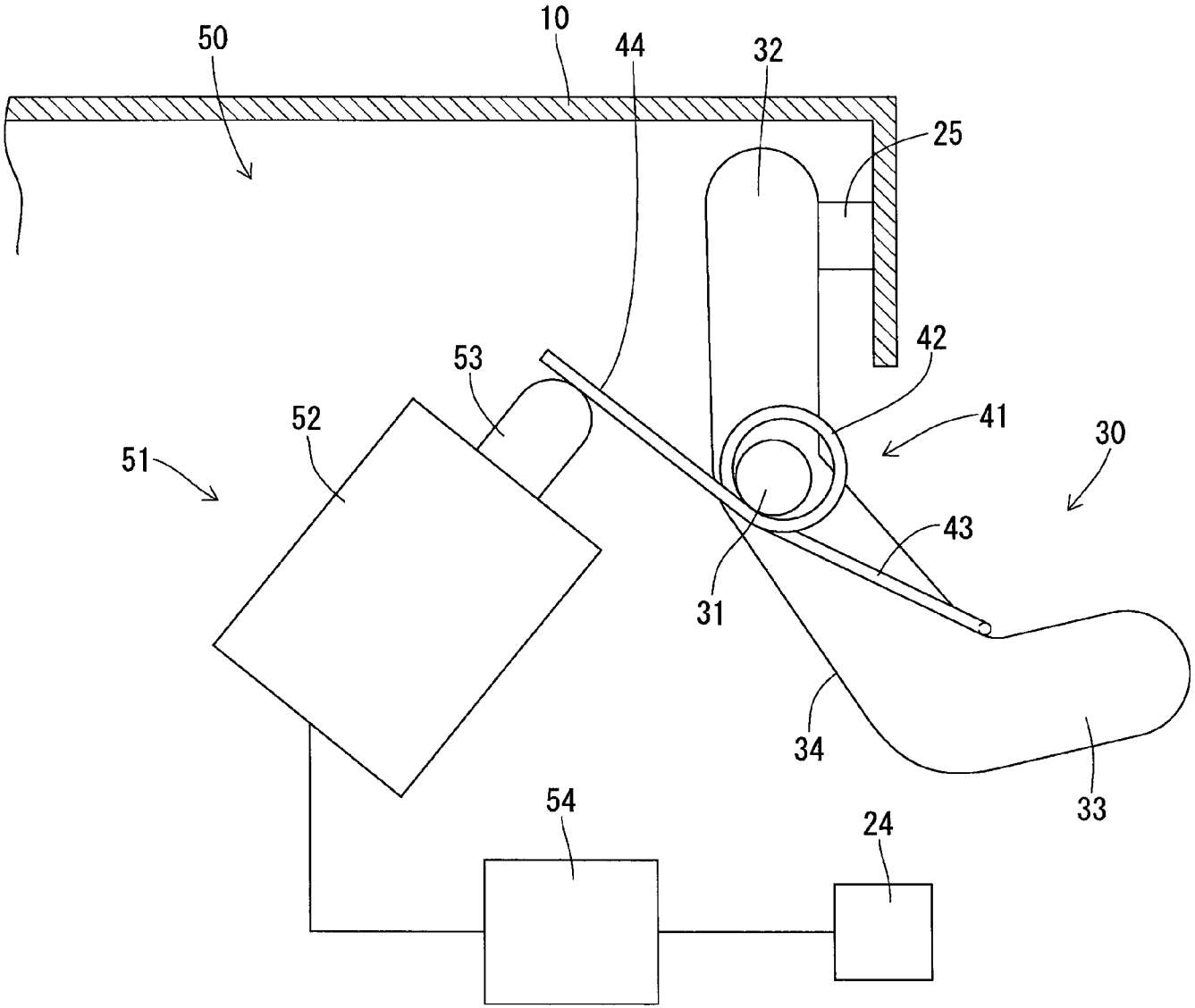
FIG. 7 is a partially enlarged side view of the pressing force changing unit of FIG. 6 showing a state in which a pressing force of the pressing member on the sheet is weakened.

Referring to FIGS. 6 and 7, a second exemplary embodiment of the invention will now be described. FIG. 6 is a partially enlarged side view showing a pressing force changing unit 50 according to the second exemplary embodiment.

FIG. 7 is a partially enlarged side view showing a state in which the pressing force of the pressing member 30 on the sheet is weakened.

In the second exemplary embodiment, an urging force changing unit 51, which constitutes the pressing force changing unit 50, differs from the urging force changing unit of the first exemplary embodiment. The other elements are the same as in the first exemplary embodiment, and the same or like parts are designated by the same numerals, and the explanation of the structure, operation and effect is omitted.

The urging force changing unit 51 comprises an electromagnetic solenoid 52, a sheet discharging sensor 24 and control unit 54. The electromagnetic solenoid 52 switches between a state in which a plunger 53 advances and a state in which the plunger 53 retracts by the supply operation of power. The electromagnetic solenoid 52 is disposed so that the plunger 53 may make contact with the second arm 44 of the torsion coil spring 41 obliquely from the lower back side.

The sheet discharging sensor 24 detects whether the sheet conveyed toward the discharge unit 18 passes through the detection position set between the fixing unit 20 and the second turnover portion 17, and senses whether the sheet is discharged onto the sheet discharging tray 13. A detection signal from the sheet discharging sensor 24 is input into the control unit 54.

The control unit 54 detects the position of the sheet on the discharge path, based on the detection signal from the sheet discharging sensor 24. A control signal for controlling the motion of the electromagnetic solenoid 52 according to the detected position of the sheet is outputted.

Generally, the sheet passing through the fixing unit is curled so that both the right and left edges at the trailing end in the conveying direction roll up. Thus, as shown in FIG. 7, the plunger 53 is retracted, based on the control signal from the control unit 54, for the period from immediately before the leading end of the sheet in the conveying direction contacts the pressing piece 33 of the pressing member 30 until the leading end of the sheet passes under the pressing piece 33.

In this state, the elastic deformation amount of the coil portion 42 is decreased, and the elastic restoring force applied from the torsion coil spring 41 to the pressing member 30 is decreased, whereby the force of the sheet in pushing up the pressing piece 33 may be decreased. Accordingly, the pressing force applied from the pressing member 30 to the sheet is smaller, but because there is almost no curl in the leading end part of the sheet in the conveying direction, there is no harm in the function of correcting the curl even if the pressing force is small.

After the leading end of the sheet in the conveying direction passes under the pressing piece 33, but before the central part of the sheet in the conveying direction arrives at the pressing member 30, the plunger 53 is advanced, as shown in FIG. 6. Since the second arm 44 is pushed toward the oscillation regulating piece 32, the elastic deformation amount of the coil portion 42 is increased, so that the elastic restoring force applied from the torsion coil spring 41 to the pressing member 30 is greater. Accordingly, the pressing force applied from the pressing member 30 to the sheet is increased.

Thus, when the pressing force of the pressing member 30 is increased, the leading end of the sheet in the conveying direction has already passed through the pressing piece 33, whereby there is no risk of the sheet buckling and deforming. Yet the curl is securely corrected owing to the strong pressing force from the pressing piece 33 as the central part and trailing end of the sheet in the conveying direction, namely, a part where the curl occurs, passes under the pressing piece 33.

The second exemplary embodiment comprises the sheet discharging sensor 24 for detecting that the sheet conveyed toward the discharge unit 18 passes through the detection position, and the control unit 54 for outputting a control signal for changing the pressing force of the pressing member 30 using the electromagnetic solenoid 52 based on the detection signal from the sheet discharging sensor 24. In this configuration, the pressing force of the pressing member 30 can be changed dynamically from the leading end of the sheet to the trailing end in the conveying direction.

Particularly, in the second exemplary embodiment, considering that the curl occurs more intensely at the trailing end part of the sheet, the control unit 54 outputs a control signal of exerting a greater pressing force at the trailing end part of the sheet in the conveying direction than at the leading end part in the conveying direction. In this configuration, there is no risk that the leading end of the sheet pushes against the pressing member 30 and buckles to cause a paper jam, while the curl at the trailing end part of the sheet can be corrected effectively.

By effectively using the sheet discharging sensor 24 for detecting whether the sheet is discharged onto the sheet discharging tray 13, the control operation of the control unit 54 is performed based on a detection signal from the sheet discharging sensor 24. In this configuration, a single sensor may be used for both controlling the pressing force and detecting the sheet discharge, whereby the cost can be reduced.

<Other Exemplary Embodiments>

The present invention is not limited to the exemplary embodiments as given in the above description with the drawings, but the following additional exemplary embodiments may also fall within the technical scope of the invention.

For example, the pressing force of the pressing member is not limited to the spring force of the urging member, but may include a pressing force using an empty weight of the pressing member and the pressing force using a leverage principle. Specifically, the pressing member is able to oscillate, and the sheet pressing portion and the arm portion extend in the mutually opposite directions from the center of oscillation of the pressing member, and a weight attached on the arm portion is moved along the length direction of the arm portion. If the weight is moved away from the sheet pressing portion, the pressing force of the sheet pressing portion on the sheet is reduced.

The displacement form of the pressing member is not limited to the oscillation around the axis, but may include the parallel displacement.

When the pressing member is at the pressing position, the urging force is not applied to the pressing member, but after the pressing member starts to be displaced in the direction of releasing the pressing force, the urging force may be applied to the pressing member.

The urging member is not limited to the spring member, but may be an air cylinder using elasticity of the air that is a compressed fluid or a rubber member.

The urging member is not limited to the torsion coil spring, but may be a spring member in another form such as a compression coil spring or a leaf spring.

The urging force changing unit is not limited to a lever or an electromagnetic solenoid, but may include, for example, a hydraulic cylinder.

The operation portion may be operated by a unit (e.g., an actuator) rather than being operated manually.

The sheet discharging sensor is also used as the sheet detection sensor, but a dedicated sheet detection sensor for detecting that the sheet passes through the detection position may be provided separately from the sheet discharging sensor.

The pressing member may alternatively be in a continuous form over the entire width of the sheet.

The pressing member may alternatively be disposed only at the central position in the width direction.

As described above, there is provided an image forming apparatus comprising a housing; a discharge unit, provided within the housing, for discharging an image fixed sheet onto a sheet discharging tray; a pressing member, provided at a downstream position of the discharge unit in a discharging direction in the housing, and displaceable from a pressing position capable of pressing the opposite surface of the sheet to the sheet discharging tray in a direction of releasing pressure on the sheet; and pressing force changing unit for changing a pressing force of the pressing member on the sheet.

With this exemplary embodiment, the curl of the sheet can be corrected without causing a paper jam or a sheet pushing phenomenon by appropriately changing the pressing force of the pressing member on the sheet depending on the strength of curl of the sheet or thickness of the sheet.

Also, in the exemplary embodiment, the pressing force changing unit may comprise an urging member for applying an urging force in a direction pressing the sheet to the pressing member, and urging force changing unit for changing the urging force of the urging member.

With this constitution, the sheet is pressed using the urging force of the urging member, whereby the mechanism is simplified.

Also, the urging member may be a torsion coil spring in a form in which a pair of arms extend from both ends of a coil portion, and the coil portion may be disposed almost coaxially with an oscillating shaft of the pressing member, one of the arms being engaged with the pressing member and the other arm being engaged with the urging force changing unit.

With this constitution, the coil portion for producing the urging force is disposed almost coaxially with the oscillating shaft of the pressing member, whereby the space saving is made.

Also, the urging force changing unit may be a lever provided to be able to oscillate in the housing in a form in which an operation portion and an engagement portion extend from a center of oscillation, the engagement portion may be engaged with the urging member, and the engagement portion may elastically deform the urging member while being oscillated by operating the operation portion.

With this constitution, the urging force of the urging member can be changed by operating the operation portion.

Also, the operation portion may be provided in a form exposed to an outside surface of the housing, and can be manually operated.

With this constitution, the operation portion can be manually operated.

Also, the image forming apparatus may further comprise a sheet detection sensor for detecting that the sheet conveyed toward the discharge unit passes through a detection position, and control unit for outputting a control signal of changing the pressing force of the pressing member to the pressing force changing unit, based on a detection signal from the sheet detection sensor.

With this constitution, the pressing force of the pressing member can be properly changed from the leading end to the trailing end in the conveying direction of the sheet.

Also, the control unit may output a control signal for exerting a greater force on a trailing end part of the sheet in a conveying direction than the pressing force on a leading end part of the sheet in the conveying direction.

With this constitution, there is no risk that the leading end of the sheet pushes against the pressing member to cause a paper jam. Further, the curl at the trailing end part of the sheet can be effectively corrected.

Also, the sheet detection sensor may be a sheet discharging sensor for sensing whether or not the sheet is discharged onto the sheet discharging tray.

With this constitution, since the existent sheet discharging sensor is used as the sheet detection sensor, there is no need for the dedicated sheet detection sensor for detecting that the sheet passes by the detection position.

Also, a pair of pressing members may be provided to press both ends of the sheet in a width direction.

With this constitution, the curl at both ends of the sheet in the width direction can be effectively corrected.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a housing;

a sheet discharging tray;

a discharge unit, provided within the housing, the discharge unit configured to discharge a sheet to the sheet discharging tray;

a pressing member, provided at a position downstream of the discharge unit in a conveying direction of the sheet, the pressing member configured to apply a pressing force to a surface of the sheet at a pressing position; and a pressing force changing unit configured to change the pressing force of the pressing member against the surface of the sheet, the pressing force changing unit including:

an urging member configured to apply an urging force in a direction pressing the sheet to the pressing member; and an urging force changing unit configured to change the urging force of the urging member.

2. The image forming apparatus according to claim 1, wherein the pressing member comprises two pressing members, one pressing member provided at each end of the sheet in the width direction to press both ends of the sheet in the width direction.

3. The image forming apparatus according to claim 1, wherein the urging member comprises a torsion coil spring comprising two arms and a coil portion, one arm extending from either end of the coil portion, the coil portion being disposed coaxially with an oscillating shaft of the pressing member, and one of the arms being engaged with the pressing member and the other arm being engaged with the urging force changing unit.

4. The image forming apparatus according to claim 1, wherein the urging force changing unit comprises an operation portion and an engagement portion which extend from a center of oscillation, the engagement portion being engaged with the urging member, and the engagement portion elastically deforming the urging member while being oscillated by the operation portion.

5. The image forming apparatus according to claim 4, wherein the operation portion is exposed to an outside surface of the housing, and is configured to be manually operated.

6. The image forming apparatus according to claim 4, wherein the urging force changing unit is a lever comprising the operation portion and the engagement portion.

7. The image forming apparatus according to claim 1, further comprising:

a sheet detection sensor configured to detect that the sheet conveyed toward the discharge unit passes through a detection position; and a control unit configured to output a control signal to the pressing force changing unit based on a detection signal from the sheet detection sensor, the control signal for changing the pressing force of the pressing member.

8. The image forming apparatus according to claim 7, wherein the control unit controls the pressing force to exert a greater force on a trailing end part of the sheet in a conveying direction than on a leading end part of the sheet in the conveying direction.

9. The image forming apparatus according to claim 7, wherein the sheet detection sensor senses whether the sheet is discharged to the sheet discharging tray.

10. An image forming apparatus comprising:

a housing;

a sheet discharging tray;

a discharge unit, provided within the housing, the discharge unit configured to discharge a sheet to the sheet discharging tray;

a pressing member, provided at a position downstream of the discharge unit in a conveying direction of the sheet, the pressing member configured to apply a pressing force to a surface of the sheet at a pressing position;

a pressing force changing unit configured to change the pressing force of the pressing member against the surface of the sheet;

a sheet detection sensor configured to detect that the sheet conveyed toward the discharge unit passes through a detection position; and a control unit configured to output a control signal to the pressing force changing unit based on a detection signal from the sheet detection sensor, the control signal for changing the pressing force of the pressing member.

11. The image forming apparatus according to claim 10, wherein the control unit controls the pressing force to exert a greater force on a trailing end part of the sheet in a conveying direction than on a leading end part of the sheet in the conveying direction.

12. The image forming apparatus according to claim 10, wherein the sheet detection sensor senses whether the sheet is discharged to the sheet discharging tray.

13. The image forming apparatus according to claim 10, wherein the pressing member comprises two pressing members, one pressing member provided at each end of the sheet in the width direction to press both ends of the sheet in the width direction.

14. An image forming apparatus comprising:

a housing;

a sheet discharging tray;

a discharge unit, provided within the housing, the discharge unit configured to discharge a sheet to the sheet discharging tray;

a pressing member disposed downstream of the discharge unit in a conveying direction of the sheet and configured to apply a pressing force to a surface of the sheet at a pressing position; and a pressing force changing unit configured to cause the pressing member to change the pressing force of the pressing member against the surface of the sheet, the pressing force changing unit including:

an urging member configured to apply an urging force to the pressing member; and an urging force changing unit configured to cause a change in the urging force applied by the urging member.

15. The image forming apparatus according to claim 14, wherein the urging member comprises a torsion coil spring comprising two arms and a coil portion, wherein a first arm extends from a first end of the coil portion and is engaged with the pressing member, a second arm extends from a second end of the coil portion and is engaged with the urging force changing unit, and the coil portion is disposed coaxially with an oscillating shaft of the pressing member.

16. The image forming apparatus according to claim 14, wherein the urging force changing unit comprises an operation portion and an engagement portion which extend from a center of oscillation, the engagement portion being engaged with the urging member, and the engagement portion elastically deforming the urging member while being oscillated by the operation portion.

17. The image forming apparatus according to claim 16, wherein the operation portion is exposed to an outside surface of the housing, and is configured to be manually operated.

18. The image forming apparatus according to claim 14, further comprising:

a sheet detection sensor configured to detect that the sheet conveyed toward the discharge unit passes through a detection position; and a control unit configured to output a control signal to the pressing force changing unit based on a detection signal from the sheet detection sensor, the control signal causing the pressing force changing unit to change the pressing force of the pressing member.

19. The image forming apparatus according to claim 18, wherein the control signal causes the pressing force changing unit to exert a greater force on a trailing end part of the sheet in a conveying direction than on a leading end part of the sheet in the conveying direction.

* * * * *